US007557485B1

(12) United States Patent
Lynch et al.

(10) Patent No.: US 7,557,485 B1
(45) Date of Patent: Jul. 7, 2009

(54) ION CONDUCTING ELECTROLYTE BRUSH ADDITIVES

(75) Inventors: William A. Lynch, Philadelphia, PA (US); Neal A. Sondergaard, Severna Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 851 days.

(21) Appl. No.: 11/250,698

(22) Filed: Oct. 8, 2005

Related U.S. Application Data

(60) Provisional application No. 60/616,843, filed on Oct. 8, 2004.

(51) Int. Cl.
*H01R 39/18* (2006.01)

(52) U.S. Cl. ..... 310/248; 310/219

(58) Field of Classification Search ..... 310/248, 310/219, 229

See application file for complete search history.

(56) References Cited

U.S. PATENT DOCUMENTS

| | | | | |
|---|---|---|---|---|
| 920,626 | A | | 5/1909 | Noeggerath |
| 1,253,265 | A | | 1/1918 | McKeown |
| 1,668,381 | A | | 5/1928 | Schild |
| 1,812,609 | A | | 6/1931 | Rogers |
| 2,230,131 | A | | 1/1941 | Chandeysson |
| 2,247,645 | A | | 1/1941 | Suydam |
| 3,041,118 | A | | 6/1962 | Cambell |
| 3,229,133 | A | | 1/1966 | Sears |
| 3,271,603 | A | * | 9/1966 | Wiedemann ..... 310/219 |
| 3,526,797 | A | | 9/1970 | Jueschke |
| 3,579,005 | A | | 5/1971 | Noble |
| 3,584,248 | A | | 6/1971 | Higashino et al. |
| 3,735,173 | A | | 5/1973 | Wisniewski |
| 3,837,229 | A | | 9/1974 | Stiles et al. |
| 3,944,865 | A | | 3/1976 | Jewitt |
| 4,027,183 | A | | 5/1977 | Hatch |
| 4,027,184 | A | | 5/1977 | Hurley |
| 4,086,506 | A | | 4/1978 | Kustom et al. |
| 4,166,227 | A | | 8/1979 | Guglielmo |

(Continued)

OTHER PUBLICATIONS

U.S. Appl. No. 60/616,843, filed Oct. 8, 2004, entitled "Ion Conducting Electrolyte Brush Additives," joint inventors William A. Lynch and Neal A. Sondergaard.

(Continued)

*Primary Examiner*—Hae Moon Hyeon
(74) *Attorney, Agent, or Firm*—Howard Kaiser

(57) ABSTRACT

The present invention's unique utilization of an electrolytic solution renders more efficient the conduction of electricity between two objects (such as two parts of electrical or electromechanical machinery) in relative motion. According to typical inventive practice, the electrolytic solution is a "strong" electrolytic solution of a "dual-valance" nature, including two compatible solute compounds containing electron donor ions and electron acceptor ions. When inventively implemented at the current collector interface, the electrolytic solution serves to improve current transfer across the interface. During machine operation in which a brush (e.g., fiber brush) slidingly contacts a first machine part while being affixed to a second machine part, the inventive additive represents an auxiliary vehicle for conducting electrical current from one machine part to the other machine part. Among the benefits of inventive practice are reduced conduction power losses, reduced friction power losses, and reduced wear rate.

20 Claims, 14 Drawing Sheets

U.S. PATENT DOCUMENTS 4,168,446 A * 9/1979 Hatch ..... 310/219
4,186,321 A 1/1980 Marshall
4,241,273 A 12/1980 Hatch
4,246,508 A 1/1981 Zimmer
4,266,154 A 5/1981 Marshall
4,275,323 A 6/1981 Hatch
4,277,708 A 7/1981 McNab et al.
4,297,605 A 10/1981 Tak
4,311,936 A 1/1982 Ozaki et al.
4,314,171 A 2/1982 Hatch
4,340,832 A 7/1982 Cheetham et al.
4,358,699 A 11/1982 Wilsdorf
4,385,251 A 5/1983 Mallick et al.
4,398,113 A 8/1983 Lewis et al.
4,415,635 A 11/1983 Wilsdorf et al.
4,457,205 A 7/1984 Ross
4,459,504 A 7/1984 Weldon et al.
4,483,574 A * 11/1984 Chabrerie et al. ..... 439/5
4,513,495 A 4/1985 Kimberlin
4,544,874 A 10/1985 Weldon et al.
4,553,057 A 11/1985 Saeed
4,587,723 A 5/1986 Scuro
4,607,184 A 8/1986 Takahashi et al.
4,625,136 A 11/1986 Kipke
4,710,666 A 12/1987 Rindal et al.
4,767,957 A * 8/1988 Hatch ..... 310/178
4,975,609 A 12/1990 McKee
4,978,877 A 12/1990 Quirijnen
5,039,898 A 8/1991 Shiina
5,049,771 A 9/1991 Challita et al.
5,227,950 A 7/1993 Twerdochlib
5,402,461 A 3/1995 Kudo
5,530,309 A 6/1996 Weldon et al.
5,723,932 A 3/1998 Ito et al.
5,777,410 A 7/1998 Asakura et al.
5,915,988 A 6/1999 Bitsch et al.
5,957,703 A 9/1999 Arai et al.
6,073,439 A 6/2000 Beaven et al.
6,131,364 A 10/2000 Peterson
6,274,216 B1 8/2001 Gonidec et al.
6,404,094 B1 6/2002 Drexlmaier et al.
6,464,230 B1 10/2002 Tong et al.
6,628,036 B1 9/2003 Lynch et al.
6,752,634 B2 6/2004 Gonzalez et al.
6,760,965 B2 7/2004 Asao et al.
6,873,078 B1 3/2005 Piec et al.
6,903,484 B1 * 6/2005 Kuhlmann-Wilsdorf ..... 310/239
6,913,476 B2 7/2005 Yean et al.
6,991,468 B1 1/2006 Lynch et al.
7,018,249 B2 3/2006 Ries et al.
7,026,738 B1 4/2006 Lynch et al.
7,029,339 B2 4/2006 Brach et al.
7,105,983 B2 * 9/2006 Day et al. ..... 310/323.01
7,138,743 B1 11/2006 Sondergaard et al.
7,148,600 B1 12/2006 Lynch et al.
7,179,090 B1 2/2007 Lynch et al.
2004/0248479 A1 12/2004 Hein et al.

OTHER PUBLICATIONS

Leslie Spaulding, "Everything Old is New Again—Another Option in Electric Drive," *Wavelengths*, Year 2002 Excerpts, Apr. 2002, Naval Surface Warfare Center, Carderock Division, available on NSWCCD website and printed out (3 pages) on Jul. 14, 2005 at http://www.dt.navy.mil/pao/excerpts%20pages/2002/April02/Electric%20Drive.html.

"Carderock Division Bestows Its Highest Honors for Contributions to Core Values," *Wavelengths Online*, Jul.-Aug. 2005, Naval Surface Warfare Center, Carderock Division, printed out (6 pages) on Aug. 9, 2005 at https://web1.dt.navy.mil/div/intranet/wavelengths/2005/July-August2005/: see, esp., "Rear Admiral David W. Taylor Award," pp. 1-2.

L. Boyer, S. Noel and J. P. Chabrerie, "Electrochemically Activated Wear of Metal Fibre Brushes," *Wear*, vol. 116, No. 1, pp. 43-58 (Apr. 15, 1987); Abstract Only submitted herewith, available on CSA Illumina website and printed out (2 pages) on Jun. 4, 2007 at http://md1.csa.com/partners/viewrecord.php?requester=gs&collection=TRD&recid=8708630238MD&q=wear+bover+chabrerie&uid=1026060&setcookie=yes.

* cited by examiner

| ADDITIVE | Electron Donor | Electron Acceptor | E | pH | METAL |
|---|---|---|---|---|---|
| Water + $CO_2$ (very thin film) | $CH_3OH$ | $H_2CO_3$ | -0.30 | 6.4 | Copper |
| V(II) V(III) Sulfate | $V^{2+}$ | $V^{3+}$ | -0.22 | 2.4 | Copper |
| V(III) V(IV) Sulfate | $V^{3+}$ | $VO^{2+}$ | -0.30 | 2.1 | Silver |
| V(IV) V(V) Sulfate | $VO^{2+}$ | $VO_2^{+}$ | +0.99 | -0.1 | Gold |
| V(IV) V(V) Hydroxide | $HV_2O_5^{-}$ | $HVO_4^{2-}$ | -0.29 | 9.8 | Copper |
| Cr(II) Cr(III) Chloride | $Cr^{2+}$ | $Cr^{3+}$ | -0.41 | 3.7 | Copper |
| Cr(III) Cr(VI) Chloride | $Cr^{3+}$ | $HCrO_4^{-}$ | +1.08 | 1.6 | Gold |
| Cr(III) Cr(VI) Hydroxide | $CrO_3^{3-}$ | $CrO_4^{2-}$ | -0.22 | 14.4 | Silver |
| Ti(II) Ti(III) Chloride | $Ti^{2+}$ | $Ti^{3+}$ | -0.38 | 1.0 | Copper |
| Ti(III) Ti(IV) Chloride | $Ti^{3+}$ | $TiO^{2+}$ | -0.20 | -0.3 | Silver |
| Sn(II) Ti(IV) Chloride | $Sn2^{+}$ | $Sn4^{+}$ | +0.17 | 0.0 | Silver |
| Cu(I) Cu(II) Chloride | $CuCl2^{-}$ | $Cu2^{+}$ | +0.60 | 3.0 | Palladium |
| Cu(I) Cu(II) NH4Cl NH4OH | $Cu(NH_3)_2^{+}$ | $Cu(NH_3)_4^{2+}$ | +0.11 | 9.2 | Silver |
| Fe(II) Fe(III) Chloride | $Fe^{2+}$ | $Fe^{3+}$ | +0.77 | 2.0 | Gold |
| Fe(II) Fe(III) Sulfate | $Fe^{2+}$ | $Fe^{3+}$ | +0.77 | 2.0 | Gold |
| Fe(II) Fe(III) Nitrate | $Fe^{2+}$ | $Fe^{3+}$ | +0.77 | 2.0 | Gold |
| Fe(II) Fe(III) Phosphate | $Fe^{2+}$ | $Fe^{3+}$ | +0.77 | 2.0 | Gold |
| Iodide Tri-iodide | $I^{-}$ | $I_3^{-}$ | +0.40 | 4.0 | Osmium |
| Bromide Tri-bromide | $Br^{-}$ | $Br_3^{-}$ | +1.06 | 4.5 | Iridium |
| Sodium Polysulfide | $S_2^{2-}$ | $S_4^{2-}$ | -0.37 | 8.2 | Copper |
| Gallium Indium | $Ga_3^{+}$ | $Ga^{+}$ | -0.47 | 1.6 | Niobium |

FIG. 8

| SUBSTANCE | CONDUCTIVITY (mS/cm) |
|---|---|
| Distilled Water | 0.000055 |
| Saturated CO2 Solution | 0.0011 |
| 1M HF Solution | 24.3 |
| Seawater | 53 |
| 1M KCl Solution | 109 |
| 1M NaOH Solution | 155 |
| 1M HCl Solution | 332 |
| 15% NaOH Solution (max cond) | 410 |
| 20% HCL Solution (max cond) | 840 |
| NaK Eutectic Alloy | 26,000,000 |
| Gallium Indium Tin Eutectic Alloy | 27,000,000 |
| Copper | 588,000,000 |

FIG. 9

SOLUBILITY TABLE (g / 100 g H2O)

| CATION | ANION | | | | | |
|---|---|---|---|---|---|---|
| | $F^-$ | $Cl^-$ | $Br^-$ | $I^-$ | $SO4^{2-}$ | $S^{2-}$ |
| $H^+$ | very sol | very sol | very sol | 308 | very sol | soluble |
| $Li^+$ | 0.13 | 85 | 181 | 165 | 34 | insoluble |
| $Na^+$ | 4.13 | 36 | 95 | 184 | 28 | 21 |
| $K^+$ | 102 | 35 | 68 | 148 | 12 | soluble |
| $Mg^{2+}$ | 0.013 | 56 | 102 | 146 | 36 | reactive |
| $Ca^{2+}$ | 0.0016 | 81 | 156 | 215 | 0.21 | slight |
| $Cu^+$ | slight | 0.0047 | 0.0012 | 0.00002 | - | insoluble |
| $Cu^{2+}$ | 0.075 | 76 | 126 | - | 22 | insoluble |
| $Ag^+$ | 172 | 0.00019 | 0.000014 | 0.000003 | 0.84 | insoluble |
| $Au^{3+}$ | soluble | 68 | soluble | insoluble | - | unstable |
| $Pd^{2+}$ | unstable | soluble | insoluble | insoluble | - | insoluble |
| $Pt^{4+}$ | soluble | 142 | 0.41 | soluble | soluble | insoluble |
| $Fe^{2+}$ | slight | 65 | 120 | soluble | soluble | insoluble |
| $Fe^{3+}$ | 5.92 | 91 | 455 | - | 440 | - |
| $Cr^{2+}$ | slight | soluble | soluble | - | 21 | - |
| $Cr^{3+}$ | insoluble | slight | soluble | slight | acid | reactive |
| $V^{3+}$ | insoluble | reactive | reactive | reactive | slight | insoluble |
| $VO^{2+}$ | very sol | reactive | reactive | - | soluble | - |
| $Ti^{2+}$ | | reactive | reactive | reactive | acid | acid |
| $Ti^{3+}$ | insoluble | reactive | soluble | | acid | acid |
| $TiO^{2+}$ | reactive | reactive | reactive | reactive | soluble | acid |

FIG. 10

| Brush | Solution | Plate |
|---|---|---|
| Copper | Ferric, Ferrous | Iridium |
| Silver | Iodide, Triiodide | Gold |
| Gold | V(III), V(IV) | Palladium |
| Palladium | Chromic, Chromous | Platinum |
| Carbon | Polysulfide | Rhodium |
| Molybdenum | Cupric, Cuprous | Osmium |
| Niobium | Titanium(II, III, IV) | Nickel |

Each solution will be tested with the least expensive compatible brush and plating.

Solute interactions:

Common ion effect reduces solubility (sulfates)

Complex ion formation increases solubility (transition metal halides)

FIG. 11

OBSERVED ELECTRODE AND ADDITIVE COMPATIBILITIES

| Contact | $CO_2$ | Fe(III)Cl | Fe(III) SO4 | Cu(II) Cl |
|---|---|---|---|---|
| Au | 5 | 5 | 5 | 5 |
| Pd | 5 | 2 | 5 | 5 |
| Ag | 5 | 4 | 3 | 4 |
| Cu | 5 | 2 | 2 | 2 |
| Zn | 5 | 1 | 2 | 1 |

OBSERVATION

5 = No visible reaction
4 = Discoloration
3 = Dissolve 1 week
2 = Dissolve 1 day
1 = Dissolve 1 hour
0 = Rapid dissolving

FIG. 12

IRON-BASED SINGLE AND DUAL-VALENCE
SOLUTION CHARACTERISTICS AND TEST DATA

| Compound | MW Grams/ Mole | Solubility Grams/ Liter | Solubility Moles/ Liter | Solution Moles/ Liter | pH Nominal | E mV | C mS/cm | Electrode Drop mV @ 10 mA |
|---|---|---|---|---|---|---|---|---|
| Fe(II) Sulfate | 151.91 | 295 | 1.94 | 1.00 | 2.65 | 535 | 79 | 1693 |
| Fe(III) Sulfate | 199.94 | 440 | 2.20 | 1.00 | 1.25 | 789 | 38 | 1540 |
| Fe(II,III) Sulfate | 175.93 | 342 | 1.94 | 1.00 | 1.88 | 660 | 54 | 565 |
| Fe(II) Chloride | 126.75 | 650 | 5.13 | 1.00 | 2.52 | 541 | 101 | 1705 |
| Fe(III) Chloride | 162.20 | 912 | 5.62 | 1.00 | 0.82 | 959 | 93 | 420 |
| Fe(II,III) Chloride | 144.48 | 741 | 5.13 | 1.00 | 1.08 | 709 | 106 | 94 |

FIG. 13

Pourbaix Diagram Including Metal Stability Regions and Selected Additive Solution Conditions Additive Conductivity Test Data as a Function of Temperature

| Temp C | Gold Fe(II/III) Sulfate (millivolts) | Gold Fe(II/III) Chloride (millivolts) | Palladium Cu(I/II) Chloride (millivolts) |
|---|---|---|---|
| 25 | 677 | 203 | 44 |
| 30 | 615 | 186 | 38 |
| 35 | 570 | 172 | 33 |
| 40 | 536 | 156 | 29 |
| 45 | 498 | 144 | 26 |
| 50 | 456 | 133 | 24 |
| 55 | 428 | 123 | 22 |
| 60 | 402 | 115 | 20 |
| 65 | 373 | 106 | 18 |
| 70 | 352 | 99 | 17 |
| 75 | 337 | 93 | 16 |
| 80 | 321 | 89 | 15 |

1 molar solutions, pH =1.00

FIG. 16

Experimental Brush Additive Characteristics

| Compound | Solution moles/liter | Solution pH | E mV | AC Cond mS/cm | Electrode Drop mV @ 10 mA DC | DC Cond mS/cm | Conditions |
|---|---|---|---|---|---|---|---|
| Fe(II,III) Sulfate | 1.00 | 1.00 | 660 | 54 | 565 | 35 | Add $H_2SO_4$ |
| Fe(II,III) Chloride | 1.00 | 1.08 | 709 | 106 | 190 | 105 | In Water |
| Fe(II,III) Chloride | 2.00 | 0.61 | 711 | 110 | 60 | 333 | In Water |
| Cu(I,II) Chloride | 0.10 | 0.09 | 465 | 330 | 430 | 47 | 1M HCl |
| Cu(I,II) Chloride | 0.50 | -0.40 | 480 | 397 | 64 | 313 | 2.5M HCl |
| Cu(I,II) Chloride | 1.00 | -0.70 | 570 | >400 | 13 | 1538 | 5M NaCl |
| Cu(I,II) Chloride | 1.00 | 1.00 | 592 | 213 | 45 | 444 | Sat NaCl |

FIG. 17

ION CONDUCTING ELECTROLYTE BRUSH ADDITIVES

CROSS-REFERENCE TO RELATED APPLICATIONS

This application claims the benefit of U.S. provisional application No. 60/616,843, filed 8 Oct. 2004, hereby incorporated herein by reference, entitled "Ion Conducting Electrolyte Brush Additives," joint inventors William A. Lynch and Neal A. Sondergaard.

STATEMENT OF GOVERNMENT INTEREST

The invention described herein may be manufactured and used by or for the Government of the United States of America for governmental purposes without payment of any royalties thereon or therefor.

This application is related to U.S. nonprovisional application Ser. No. 10/863,844, filed 3 Jun. 2004, hereby incorporated herein by reference, entitled "Electrical Current Transferring and Brush Pressure Exerting Interlocking Slip Ring Assembly," joint inventors William A. Lynch, Wayne Marks, Jr. and Neal A. Sondergaard.

This application is related to U.S. nonprovisional application Ser. No. 10/985,074, filed 5 Nov. 2004, hereby incorporated herein by reference, entitled "Solid and Liquid Hybrid Current Transferring Brush," joint inventors Neal A. Sondergaard and William A. Lynch.

This application is related to U.S. nonprovisional application Ser. No. 10/985,075, filed 5 Nov. 2004, hereby incorporated herein by reference, entitled "Folded Foil and Metal Fiber Braid Electrical Current Collector Brush," joint inventors William A. Lynch, Neal A. Sondergaard and Wayne Marks, Jr.

This application is related to U.S. nonprovisional application Ser. No. 11/033,619, filed 13 Jan. 2005, hereby incorporated herein by reference, entitled "Quad Shaft Contrarotating Homopolar Motor," joint inventors William A. Lynch and Neal A. Sondergaard.

BACKGROUND OF THE INVENTION

The present invention relates to machinery involving the conduction of electrical current between parts moving relative to each other, more particularly to methods and devices for effecting or facilitating such electrical conduction.

Various kinds of motors, generators and other electrical apparatus require the conduction of electricity between two relatively moving parts. Such mechanical arrangements usually involve the conduction of current between a stationary part (stator) and a rotating part (rotor). A device known as a "brush" or "current collector" is normally used for making sliding contact between stationary and rotating parts so as to conduct electrical current therebetween. A conventional current collection assembly includes a brush and a "holder" (for the brush) as two separate components that are attached to each other. The holder is also attached to either the stationary part or the rotating part of the machinery.

Depending on the particular machinery, a brush can be used to conduct current in either direction (i.e., either from the stationary part to the rotating part, or vice versa), and can be fixed with respect to either the rotating part or the stationary part. Among the desirable qualities of a brush are high current-carrying capacity (e.g., in terms of capability of carrying a high amount of current per unit area of the interface between the brush and the surface contacted thereby), low resistance, low friction, and high wear resistance. Current collection brush technology has grown in interest with the advent and continued development of homopolar machine technology, particularly in the realm of homopolar motors (which operate on direct current) such as those that are currently envisioned for naval ship propulsion.

Conventional brushes include solid (e.g., carbon) brushes and metal fiber (e.g., copper) brushes. The majority of brushes currently used are of the solid carbon variety. Solid carbon brushes provide limited power densities due to their characteristically small number of contact spots. In addition, solid carbon brushes tend to have a short life and to produce conductive wear debris, resulting in frequent brush replacement and frequent machinery cleaning and associated high maintenance costs. Generally speaking, as compared with solid carbon brushes, copper fiber brushes are considered to afford superior performance. However, copper fiber brushes are currently expensive to produce and can support only moderate current densities.

Furthermore, fiber brushes are prone to wear, frequently manifested as a fiber brush "wear-in" contour that matches the curvature of the rotor that is in constant running contact with the fiber brush. The fiber brush wear, sometimes resembling welding-like damage, may result from friction and/or from electrical sparking associated with the fiber brush's sliding contact with the relatively moving machine part. Moreover, the electrical conductivity of fiber brushes is characterized by discontinuities concomitant with the intermittencies of contact by the fibers with the relatively moving machine part. Such contact intermittencies are occasioned by the running nature of the contact in conjunction with the roughness, often microscopic, of the surface of the relatively moving machine part. It has been estimated that a typical brush fiber is in actual physical contact with the relatively moving machine part only about one-third of the time during which the machinery is in operation; hence, each fiber represents a non-contributor to the overall electrical conduction during about two-thirds of the period of machine operation.

Liquid metal additives have been investigated for use in conjunction with fiber brushes in order to alleviate the above-noted conductive intermittency. Although a liquid metal material can succeed in lending constancy or smoothness to the electrical conduction between the brush and the slidingly contacted machine part, the high electrical conductivity of the liquid metal material invites electrical problems in the machinery such as involving short circuiting. Liquid metal brushes are capable of supporting very high current densities, but more research is needed in this area because of problems concerning stability and reactivity. Liquid metals have been tested, with some success, in association with small brushes for high performance current collection in homopolar motors. Generally, liquid metals require very clean operating environments absent oxygen and water. Since liquid metals are highly conductive, unwanted electrical connection of adjacent slip rings can occur (especially at locations where the liquid metal may drip or migrate, such as the bottom of the machine), resulting in short circuits in the machine.

Notable liquid metals that have been tested in current collection context are sodium-potassium (NaK) alloy and various gallium alloys. NaK (an alloy of sodium with potassium, approximately 22% Na and 78% K) has performed well in a range of applications, including both generators and motors. NaK does not react with most materials normally used in electrical machines; however, NaK is a water-reactive, caustic alkali metal, so spillage of this hazardous material is to be avoided. Gallium alloys have similar conductivity attributes, but because of their higher densities and viscosities these metallic materials are best suited for use with low speed propulsion motors. Because gallium alloys slowly react with copper (possibly by forming an alloy with the copper), all copper surfaces must be plated with a suitable non-reactive metal; nevertheless, gallium alloys are non-hazardous and should be further evaluated for current collector applications.

SUMMARY OF THE INVENTION

In view of the foregoing, it is an object of the present invention to improve the conduction of electrical current between a fiber brush and a machine part that the fiber brush slidably contacts.

Another object of the present invention is to reduce the wear of a fiber brush that slidably contacts a machine part.

The present invention provides a liquid additive—a "strong" electrolytic solution—that is designed to enhance the performance of brushes by providing a uniform electrically conductive interface. The inventive electrolytic solution promotes constancy of electrical conduction at the interface by compensating, via ionic electrical conduction, for intermittencies of electronic electrical conduction that are associated with the "fiber bouncing" resulting from microscopic surface roughness characterizing the running surface of the object that contacts the brush fibers while moving relative thereto. A typical inventive electrolytic solution contains both electron acceptor ions and electron donor ions, which can conduct electrical current without undergoing any net change in composition. Such a dual electrolytic solution, containing both an oxidizing agent and a reducing agent, serves not only to provide a uniform electrically conductive interface, but also serves to protect the electrodes in applications such as involving high current density slip ring current collector devices.

In accordance with typical embodiments of the present invention, a combination suitable for current collection applications comprises electronic conduction means and ionic conduction means. The electronic conduction means includes plural (e.g., multiple) fibers for effecting electronic conduction during relatively moving contact of the fibers with a structure. The contact of at least some of the fibers is characterized by intermittency associated with the relatively moving nature of the contact along with surface roughness characterizing the structure. The electronic conduction is characterized by discontinuity associated with the intermittency. The ionic conduction means includes a strong electrolytic solution for effecting ionic conduction when placed in the vicinity of the contact. The ionic conduction supplements the electronic conduction so as to promote the constancy of the overall conduction of electricity, the overall conduction representing the sum of the ionic conduction and the electronic conduction. According to frequent inventive practice, the electrolytic solution is an inorganic aqueous solution including an oxidizing agent and a reducing agent; however, non-aqueous solutions and/or organic solutes may also be utilized. An at least substantially neutral electrochemical cell reaction occurs in which the fibers constitute a first electrode and the structure constitutes a second electrode.

The conventional scientific (electrical, chemical and electrochemical) concepts noted in the instant paragraph are germane to the present invention. A chemical solution includes a solvent and a solute; the solute is dissolved in the solvent. An aqueous solution is a chemical solution in which the solvent is water. An electrolyte is a chemical substance that, when dissolved, ionizes to produce an electrically conductive medium. An ion is an electrically charged chemical particle, such as an atom, a molecule or a molecular fragment. An electrolytic solution is a chemical solution that can conduct electricity because its solute is ionically dissociated. Ions can be separated from an electrolytic solution using electrically charged electrodes. Many aqueous solutions are electrolytic solutions, as many substances (e.g., acids, bases, and salts) dissociate in water to form positively charged ions (cations) and/or negatively charged ions (anions) that enable the solution to conduct electricity. Anions are characterized by an excess of one or more electrons. Cations are characterized by a deficiency of one or more electrons. Electrical current is the movement of electrical charges in a conductor. There are two basic kinds of conductors, namely, an electronic conductor (a material that conducts electricity by electron motion) and an ionic conductor (a material that conducts electricity by ion motion). An electrolytic solution is a notable example of an ionic conductor. According to electronic conduction, electrical charges are carried by electrons. According to ionic conduction, electrical charges are carried by ions.

The present invention's liquid additive represents an attractive alternative to liquid metals for use in association with current collector brushes. The inventive liquid material typically includes moderately strongly conductive electrolytes in solution. Although the inventive electrolytic solution has sufficient conductivity to enhance brush operation, the inventive electrolytic solution is significantly less conductive than liquid metals, thereby significantly reducing the risks of shunt leakage and short circuiting. In addition, the present invention's electrolytic additives should be sufficiently conductive to allow for brush operation with a significantly thicker film than the water ($H_2O$) and carbon dioxide ($CO_2$) film that is currently used in a vaporous manner for lubrication and/or anti-oxygenation purposes in association with fiber brushes.

The water-plus-CO2 solution that is currently known in fiber brush current collection context is one of many known formulations of weak electrolytic solution. A weak electrolytic solution is one in which there is partial (typically, slight or minimal) ionization (dissociation of ions) of the electrolytes in the solution; that is, the electrolyte solute(s) behave(s) weakly in that solvent. A strong electrolytic solution is one in which there is complete or nearly complete ionization (dissociation of ions) of the electrolytes in the solution; that is, the electrolyte solute(s) behave(s) strongly in that solvent. Data on solution and other material characteristics can be found in reference text books such as *CRC Handbook of Chemistry and Physics,* $82^{nd}$ Edition, edited by David R. Lide, QD65.C57, 2001, as well as in manufacturer's data. For purposes of quantitatively demarcating herein between a weak electrolytic solution and a strong electrolytic solution, hydrofluoric acid (HF), which is partially dissociated in water, is availed of herein (with some approximation) to establish the lower limit of a strong electrolytic solution. Hydrofluoric acid serves as baseline for a moderately strong electrolyte, having a conductivity at 1 mole/liter of 24.3 mS/cm and a pH of 3.2.

The term "weak electrolytic solution," as used herein, is an electrolytic solution characterized by an electrical conductivity of less than 10 mS/cm at 1 molar concentration. Hence, hydrofluoric acid is proximate the lower end of the range corresponding to the strong electrolytic solution category. Most weak electrolytic solutions, such as carbonic acid (CO2 solution), acetic acid solution (vinegar) and ammonia solution, are orders of magnitude weaker than this and are nearly neutral in pH. The term "strong electrolytic solution," as used herein, is an electrolytic solution characterized by an electrical conductivity of 10 to 1000 mS/cm at 1 molar concentration. More generally expressed, a weak electrolytic solution is less conductive than hydrofluoric acid, and a strong electrolytic solution is at least as conductive as hydrofluoric acid. Generally, a strong electrolytic solution is very much more electrically conductive than is a weak electrolytic solution. A typical electrolytic solution in accordance with the present invention is a strong electrolytic solution; nevertheless, some weak electrolytic solutions may also lend themselves to inventive practice. Generally, a weak electrolytic solution (such as CO2 aqueous solution) cannot be applied as thickly to a current collection interface as can a strong electrolytic solution, as a weak electrolytic solution that is laid on too thickly will inhibit the electrical conduction at the interface. A thick film of inventive electrolytic solution can permit a brush to operate at a very light load, thereby significantly reducing both the wear and the power loss.

A typical formulation of the present invention's electrolytic additive solution is significantly more electrically conductive than is the CO2 water solution conventionally used for non-conductive purposes with fiber brushes. For instance, at 25° C.: A 10 molar HCl solution has a conductivity of 708 ms/cm; a 1 molar KCl solution has a conductivity of 109 mS/cm; a CO2 saturated water solution has a conductivity of 0.0011 mS/cm; seawater has a conductivity of 53 mS/cm. Accordingly, a thicker liquid layer at the interface is practical with those among the present invention's ionic conductive additives that are strongly electrolytic. Inventive practice is very much preferred with strong electrolytic solutions rather than weak electrolytic solutions, as the latter only permits application in the interface as a thin layer. In fact, a weak electrolytic solution may be insignificantly capable or thoroughly incapable of providing, in accordance with inventive principles, an ionically conductive vehicle that serves to supplement an electronically conductive vehicle for conducting electricity. Weak electrolytic solutions cannot significantly advance electrical conduction uniformity, due to the insufficiency of the ionic electrical conduction that would be associated with the relatively low number of ions of the weak electrolytes. Nor is a weak electrolytic solution capable of counteracting the physical tendencies toward asperities in electronic electrical conductivities by brush fibers. Furthermore, a thin layer of a weak electrolytic solution, even in dual-species oxidant-reductant form, is not strong enough to reduce brush wear through an electrochemical neutralization mechanism.

Many embodiments of the inventive additive eliminate wear caused not only by fiber bouncing mechanisms but also by electroplating mechanisms. The present invention's electrolytic solution, as typically embodied, is an electrolytic solution similar to the kind that has been used (and known to work) in flow batteries. A typical inventive electrolytic solution includes both electron donor ions and electron acceptor ions within an aqueous solution.

According to frequent inventive practice, the inventive electrolytic solution is situated so as to form a film in the interface between a brush and a relatively moving machine part. During operation of the machinery, the inventive electrolytic solution provides, through the inventive electrolytic solution, an electrochemical path for current flow. For inventive embodiments in which the electrolytic solution contains both an oxidant and a reductant, current is carried by the present invention's electrolytic solution so that the ensuing net reaction within it is neutral (zero). The total reaction of the inventive electrolytic solution is an electrochemical nullity; hence, the inventive electrolytic solution should last indefinitely.

A dual-species oxidant-reductant kind of inventive electrolytic solution (i.e., one which includes both proton donor ions and proton acceptor ions) can minimize brush wear associated with anodal electrochemical etching mechanisms, thereby eliminating the anode-cathode effect previously observed in testing of many types of metal fiber brushes. The inventive additive provides an alternate low impedance current conduction path, thereby eliminating accelerated positive brush wear that may be associated with the formation of metal oxide or metal cations and the accompanying anodic etching. According to typical inventive practice, during machine operation a brush experiences ultra low friction and light loading; the inventive liquid interface layer affords minimal frictional loss and minimal brush wear. A moderately strong conductivity electrolytic additive material can provide optimal trade-off between transport current conduction-related power loss and magnetically induced circulating current-related power loss. No net change will occur in the solution or at the electrodes, which are thus inert electrodes. Slip ring motion can result in mixing of the electrolytic solution, thereby preventing polarization or stratification in the electrolyte.

Generally, the present invention's additive materials are corrosive. Therefore, for many inventive embodiments, gold-plated silver brushes may be required, and other parts of the machinery may require plating with a hard noble metal such as iridium. The prospects for successful practice of the present invention are great so long as a given inventive additive is teamed with suitable metal materials for the two relatively moving machine parts (e.g., fiber brush and rotor) that define the interface at which the inventive additive is to be situated. For instance, depending on the inventive embodiment, copper may or may not be a suitable electrically conductive material for the brush fibers. Copper-based Cu(I) and Cu(II) solutions can also provide acceptor and donor ions, but stable cuprous Cu(I) cations only exist in solutions with complex ions such as halide salts and acids. These copper-based electrolytic solutions should not be used with copper brushes, but can be used with gold brushes and possibly with gold-plated silver brushes. vanadium, titanium and polysulfide solutions may be suitable. Chromium, vanadium, titanium and polysulfide solutions may be suitable for use with copper brushes. Copper brushes may corrode or become coated with a thin passive coating. Silver brushes would represent a higher risk than gold brushes but a lower risk than copper brushes, and may be suitable for most conductive solutions. Gold brushes are almost certainly compatible with most solutions, but have higher initial costs.

There are at least two preferred modes for applying an inventive electrolytic solution in a current collector context in accordance with the present invention. According to a first inventive mode, the electrolytic solution is dripped onto the brush (or brushes). According to a second inventive mode, the electrolytic solution is contained in a sealed environment for the current collector apparatus such as including slip rings. According to a third mode for applying an inventive electrolytic solution in a current collector context in accordance with the present invention, the electrolytic solution is caused to be transmitted by the brush fibers themselves in a manner pursuant to principles disclosed by the aforementioned U.S. patent application entitled "Solid and Liquid Hybrid Current Transferring Brush," joint inventors Neal A. Sondergaard and William A. Lynch.

Inventive practice of liquid additives should be suitable in association with solid brushes. Nevertheless, fiber brushes will generally provide greater current densities because of their larger surface areas in contact with the inventive electrolytic fluid. The present invention admits of diverse application. For instance, a slip ring can use two solid non-contacting surfaces, or a non-contacting fiber brush, or a lightly loaded fiber brush, or two non-contacting fiber brushes. If the electrolytic solution is corrosive to low temperature solders, the fiber brushes will likely require attachment to their holders using an alternative material such as eutectic 72% silver 28% copper braze, to avoid solder corrosion. Alternatively, the present invention can be practiced so as to implement a novel unitary device conceived by the present inventors, which combines the brush and holder components.

BRIEF DESCRIPTION OF THE DRAWINGS

The present invention will now be described, by way of example, with reference to the accompanying drawings, wherein:

FIG. 4 illustrates asperity characterizing the electrical conduction between the brush fiber and the relatively moving object.

FIG. 5 illustrates an amelioration of the asperity that is shown in FIG. 4, resulting in an enlargement of the area of electrical conductivity between the brush fiber tip and the relatively moving object.

FIG. 8 is a table listing dual valance electron donor and electron acceptor conductive electrolytes that may be suitable for inventive practice, and also indicating metals that may be compatible therewith.

FIG. 9 is a table listing electrical conductivities of various materials.

FIG. 10 is a table indicating solubilities of various combinations of cations and anions in water.

FIG. 11 is a table indicating various combinations of metal brush materials, electrolytic solutions, and metal plating materials that may be appropriate for further investigation, or practice, in accordance with the present invention.

FIG. 12 is a table indicating some inventive test results of compatibilities of various combinations of metal electrode materials and electrolytic solutions.

FIG. 13 is a table indicating inventive solution characteristics and test data for four Iron-based single-valence electrolytes and two Iron-based dual-valence electrolytes.

FIG. 16 is a table indicating, for each of three additive solutions in accordance with the present invention, conductivity (high conductivity proportional to low millivolts) of the inventive additive solution as a function of temperature (degrees C.).

FIG. 17 is a table indicating characteristics and test data for each of three iron-based dual valance aqueous solutions and four copper-based dual valance aqueous solutions in accordance with the present invention.

DETAILED DESCRIPTION OF THE INVENTION

Figure 1:
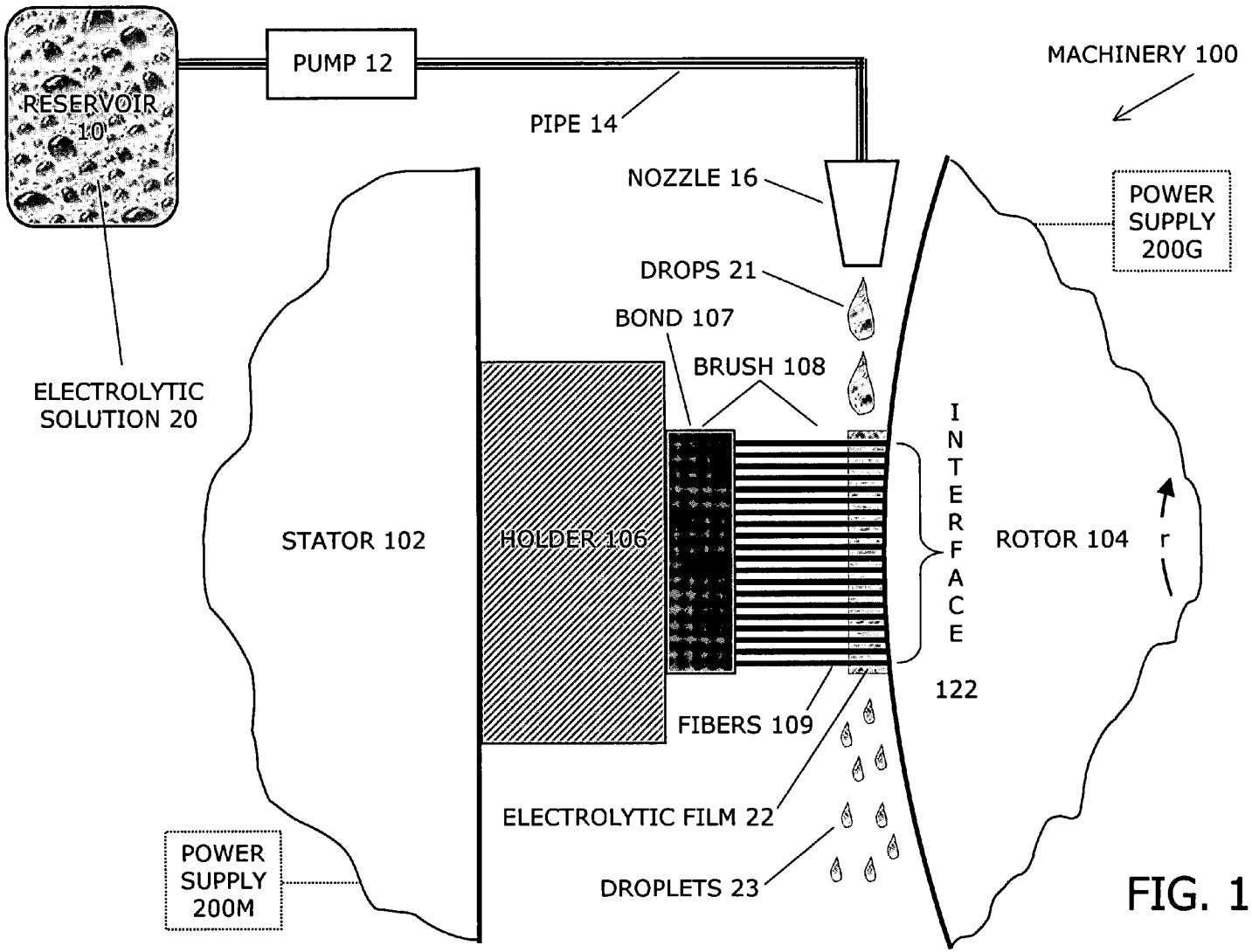
FIG. 1 is an elevation view of a portion of machinery in which a fiber brush is mounted (via a holder) onto a stator and is in sliding contact with a rotor, wherein, in accordance with an embodiment of the present invention, an electrolytic solution is dripped upon the interface between the fiber brush and the rotor.
Figure 2:
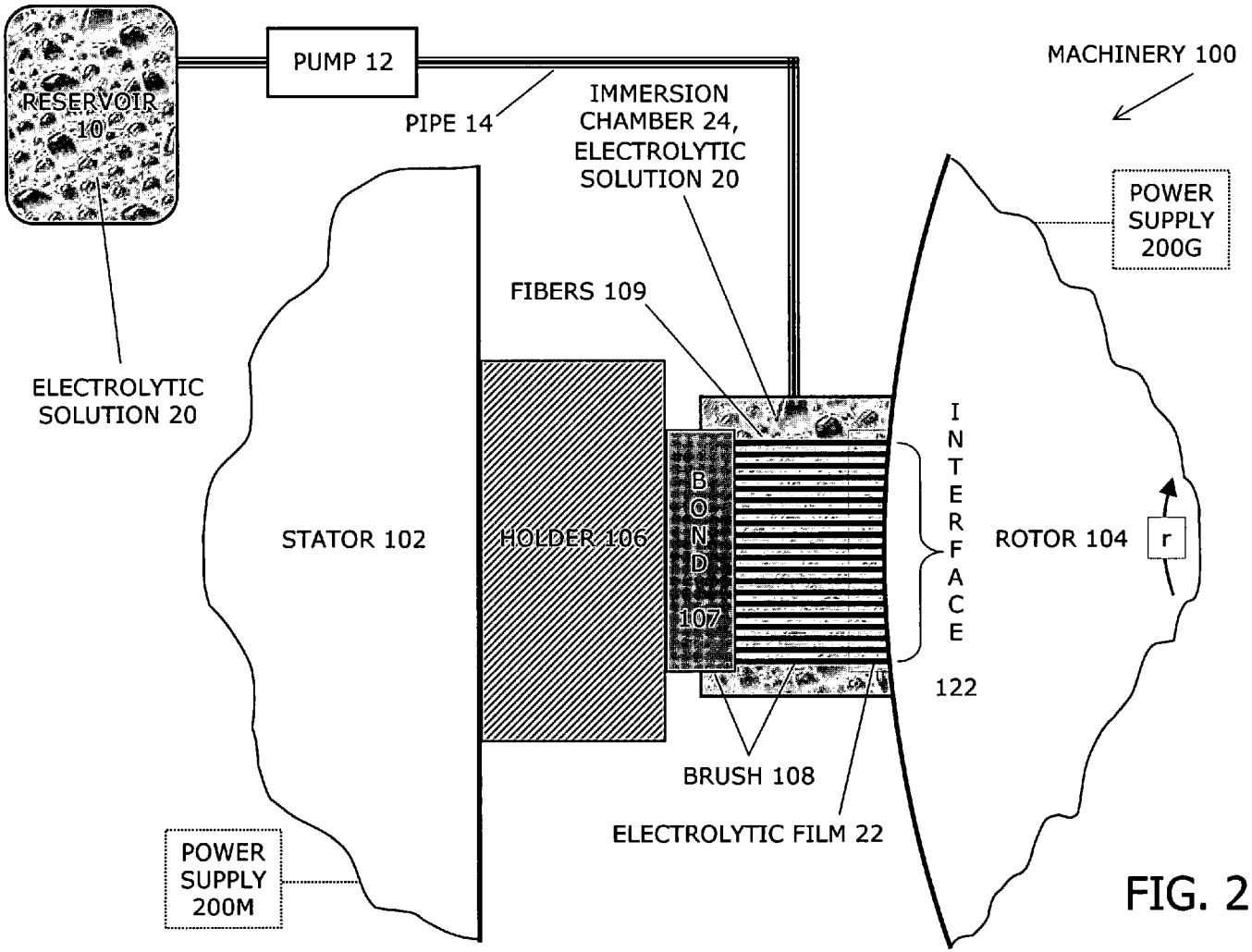
FIG. 2 is an elevation view, similar to the view of FIG. 1, of a portion of machinery in which a fiber brush is mounted (via a holder) onto a stator and is in sliding contact with a rotor, wherein, in accordance with an embodiment of the present invention, an electrolytic solution is contained surrounding the interface between the fiber brush and the rotor.

Referring now to FIG. 1 and FIG. 2, a holder 106 is mounted upon a stator 102. Brush 108, which includes multiple fibers 109 and a bonded section 107 of fibers 109, is fixedly held at bonded section 107 by holder 106. The exposed portions of brush fibers 109 contact rotor 104 at interface 122. Rotor 104 rotates (about a rotational axis) in a rotational direction r and is hence moving relative to the stationary brush 108. Interface 122, the interface between the exposed brush fibers 109 and the rotor 104 surface, is constantly moving along the rotor 104 surface in accordance with the rotation of rotor 104. Outside of inventive practice, a holder is used not only to hold a brush but also to exert a bias (e.g., in spring-like fashion) against the brush in the direction of the relatively moving object that is slidingly contacted by the brush. In inventive practice, depending on the inventive embodiment, holder 106 may be devised to exert a less forceful bias (e.g., a slight bias) against brush 108 than is usually seen by a holder with respect to a brush in non-inventive practice; in fact, in inventive practice, a holder 106 may even be designed so that exertion of bias against the brush 108 is obviated completely.

FIG. 1 and FIG. 2 can each be conceived as portraying machinery 100 either of a motor variety (wherein current is conducted from power supply 200M, to stator 102, then through holder 106, then through brush 108 and electrolytic solution film 22, to rotor 104) or a generator variety (wherein current is conducted from power supply 200G, to rotor 104, then through electrolytic solution film 22, then through brush 108, then through holder 106, to stator 102). In the case of motor-type machinery 100, an electrical power supply (e.g., battery) 200M is electrically connected, either directly or indirectly, to stator 102; stator 102 receives the current (e.g., direct current) from power supply 200M and conducts the current to the current collection apparatus (which includes holder 106, brush 108 and electrolytic solution film 22), which conducts the current to rotor 104. In the case of generator-type machinery 100, an electrical power supply (e.g., battery) 200G is electrically connected (usually indirectly through another current collector slip ring) to rotor 104; rotor 104 receives the current (e.g., direct current) from power supply 200G and conducts the current to the current collection apparatus (which includes holder 106, brush 108 and electrolytic solution film 22), which conducts the current to stator 102. Although FIG. 1 and FIG. 2 portray a brush 108 as affixed to a stator 102 for sliding contact of brush 108 with a rotor 104, the present invention can also be practiced in arrangements in which a brush 108 is affixed to a rotor 104 for sliding contact of brush 108 with a stator 102.

As illustrated in FIG. 1, a liquid electrolytic solution 20 is contained in a tank or receptacle such as a reservoir 10. Electrolytic solution 20 is pumped from reservoir 10 via pump 12 and along pipe 14, and is dispensed via nozzle 16 at the sliding contact interface 122 between the fibers 109 of brush 108 and the surface of rotor 104. Drops 21 of electrolytic solution 20 are continually deposited (e.g., dripped) onto interface 122 so as to generate an ongoing film 22 of electrolytic solution 20, film 22 extending at least substantially throughout interface 122. By force of gravity, droplets 23 of electrolytic solution 20 fall beneath interface 122 (e.g., toward the ground or floor, or onto lower parts of the machinery). The solution may be collected and re-circulated to the reservoir 10.

It is noteworthy that, as distinguished from liquid metal materials that have been tested in current collection context, the electrolytic solutions 20 in accordance with the present invention are well suited for an inventive "drip" configuration such as shown in FIG. 1. A liquid metal is much more highly electrically conductive than is a typical inventive electrolytic solution 20. It would be less practical or more complicated to drip the liquid metal in an analogous manner because of the risk posed by falling liquid metal droplets (which are characterized by high electrical conductivity) of deleterious electrical events such as involving short-circuiting.

As illustrated in FIG. 2, a liquid electrolytic solution 20 is contained in a vessel such as an immersion chamber 24. Due to the immersion of at least a portion of brush 108 in electrolytic solution 20 inside immersion chamber 24, a film 22 of electrolytic solution 20 is continuously present at interface 122. According to some inventive embodiments, apparatus such as including a reservoir 10, a pump 12 and a pipe 14 is implemented to periodically (e.g., timed) or selectively replenish the electrolytic solution 20 contained within immersion chamber 24. Similarly as provided by the inventive configuration shown in FIG. 1, a film 22 of electrolytic solution 20 is present at interface 122 on an ongoing basis and extends at least substantially throughout interface 122.

Figure 3:
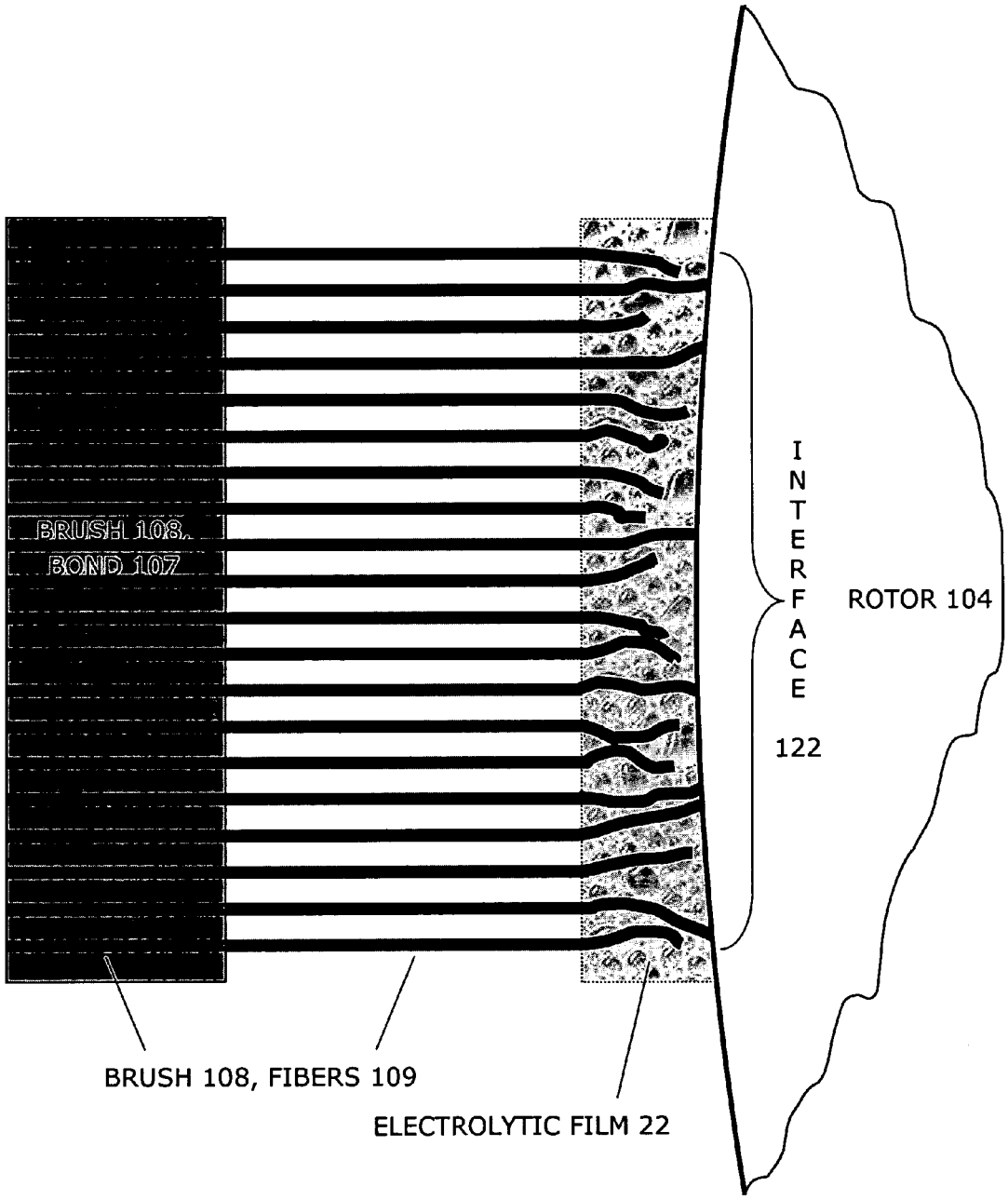
FIG. 3 is a partial and enlarged version of the view of FIG. 1, illustrating "jumping" of the brush fibers (and concomitant intermittency of contact of the brush fibers with the rotor's running surface) due to microscopic roughness of the rotor's running surface.

Reference is now made to FIG. 3, which depicts the fiber 109 bouncing phenomenon that takes place at interface 122. The distances of fibers 109 from the rotor 104 surface are exaggerated in FIG. 3 for illustrative purposes. No mechanical surface is perfectly smooth. Even a macroscopically even rotor 104 surface is characterized, on a microscopic scale, by surface roughness. As rotor 104 rotates, the surface roughness of rotor 104 causes the fibers 109 to "bounce" (e.g., rebound, jump or ricochet) microscopic distances from the rotor 104 surface. According to L. Boyer, S. Noel and J. P. Chabrerie, Wear, vol. 116, pages 43-57 (1987), incorporated herein by reference, at any one moment in time only approximately one-third of the brush fibers at a current collector interface are in actual physical contact with the relatively moving surface. Based on this teaching by Boyer et al., perhaps it is fair to assume for many inventive applications that, at any particular moment in time during machine operation, less than one-half of fibers 109 will actually be contacting the running surface of rotor 104. Because the fibers 109 bounce around, at least half and perhaps two-thirds of fibers 109 being separated from the rotor 104 surface from moment to moment, the electronic electrical conduction by the fibers 109 to (or from) rotor 104 is commensurately discontinuous (intermittent), and its average value is proportionally lower.

The film 22 of electrolytic solution 20 promotes constancy (uniformity) of the overall electrical conduction at interface 122. The overall electrical conduction equals the sum of the electronic electrical conduction that occurs via the brush fibers 109 and the ionic electrical conduction that occurs via the electrolytic solution film 22. The electrolytic solution film 22 provides an auxiliary electrically conductive mechanism (i.e., an ionically electrically conductive mechanism) that supplements the electronically electrically conductive mechanism provided by the brush fibers 109. The ionic conduction by the electrolytic solution film 22 not only supplements, but also complements, the electronic conduction by the brush fibers 109, by exerting a smoothing influence on the overall electrical conduction at interface 122. Otherwise expressed, the electronically conductive discontinuity is tempered by the ionically conductive continuity, thereby promoting the evenness of the overall electrical conduction.

Figure 5:
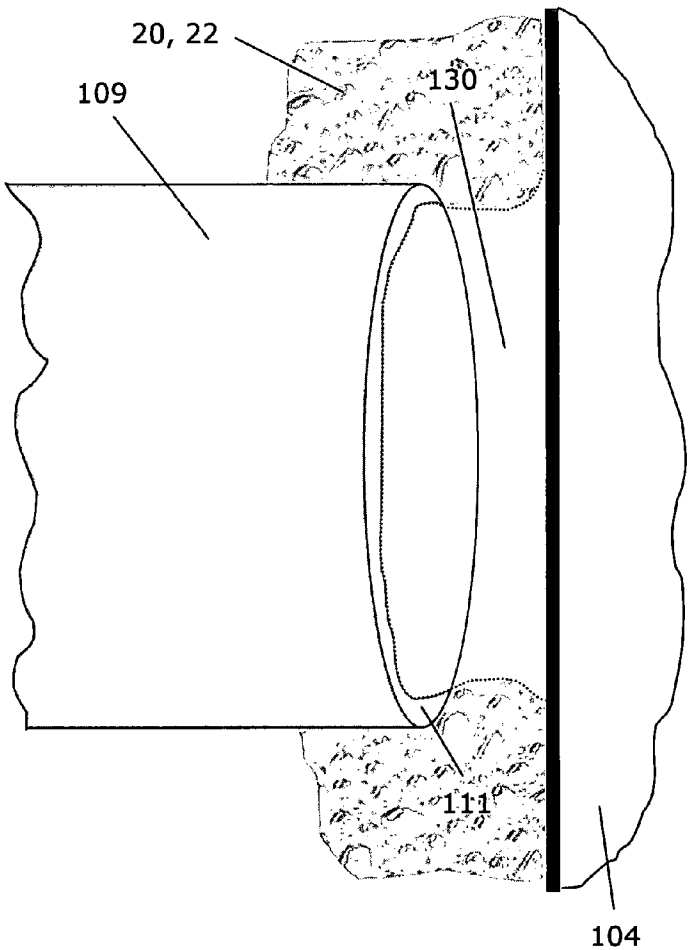
FIG. 5 is a perspective view, similar to the view shown in FIG. 4, of a single brush fiber forming an electrical contact with a relatively moving object (such as a rotor) in the presence of the present invention's additive.
Figure 4:
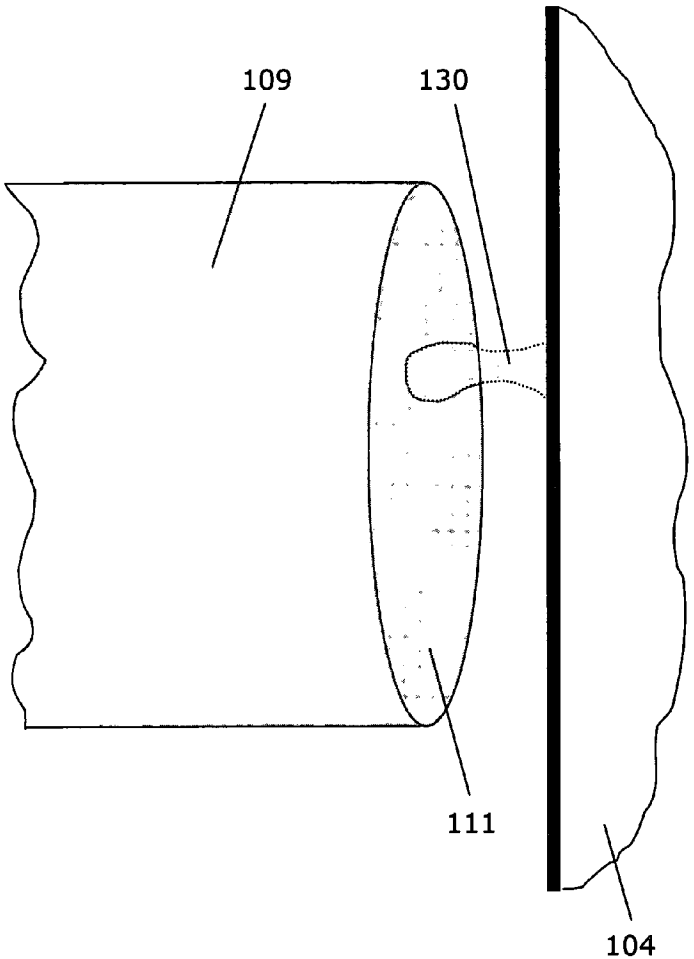
FIG. 4 is a perspective view of a single brush fiber forming an electrical contact with a relatively moving object (such as a rotor) in the absence of the present invention's additive.

With reference to FIG. 4 and FIG. 5, asperities are microscopic roughness elevations of a surface of a material. An asperity spot (abbreviated "a-spot") is the point of physical contact between an asperity on one surface and an asperity on another surface. When the respective surfaces of electrical contacts are mated, physical contact occurs only at one or more asperity spots (a-spots). Each a-spot is elastically/plastically flattened to form a small contact area through which the electronic conduction of electrical current is constricted. The number of a-spots and their sizes and arrangement can affect the performance and longevity of the electrical contact. Most of the electrical resistance of brush 108 is associated with the voltage drop across interface 122. As depicted in FIG. 4 (which shows one asperity spot 130), the current in each fiber 109 is constricted in one or a few small asperity spots 130 on the tip 111 of each fiber 109. The fiber tip 111 area that carries current is only a small portion of the total fiber tip 111 area. The area of the a-spot is known to the electrical contact industry to be small (e.g., on the order of 1% of the area of a typical fiber in a metal fiber brush), as disclosed in references such as Ragnar Holm, *Electric Contacts Theory and Application,* $4^{th}$ Edition, TK2821H74, 1967, and *Electrical Contacts Principles and Applications*, Edited by Paul G. Slade, TK2821.E34, 1999. Each a-spot 130 is likely to occur at an asperity (high point) on the fiber tip 111 micro-roughness, and is likely to move around on the fiber tip 111 because of the micro-roughness of the running surface of rotor 104. Moreover, fibers 109 are likely to jump over the micro-roughness characterizing rotor 104's running surface, so each fiber 109 is not conducting electricity some of the time. The present invention's liquid additive 20 can serve to facilitate electrical conduction over the entire (or nearly the entire) fiber tip 111, such as illustrated in FIG. 5. The constantly present film 22 of electrolytic solution 20 serves to increase the areas of conductance (a-spots 130) in fibers 109. Depending on characteristics of the electrolytic film 22 such as thickness, the electrical current conduction may be described by the mechanism depicted in FIG. 5, or by the simultaneous combination (acting in parallel) of the mechanisms depicted in FIG. 4 and FIG. 5.

Figure 6:
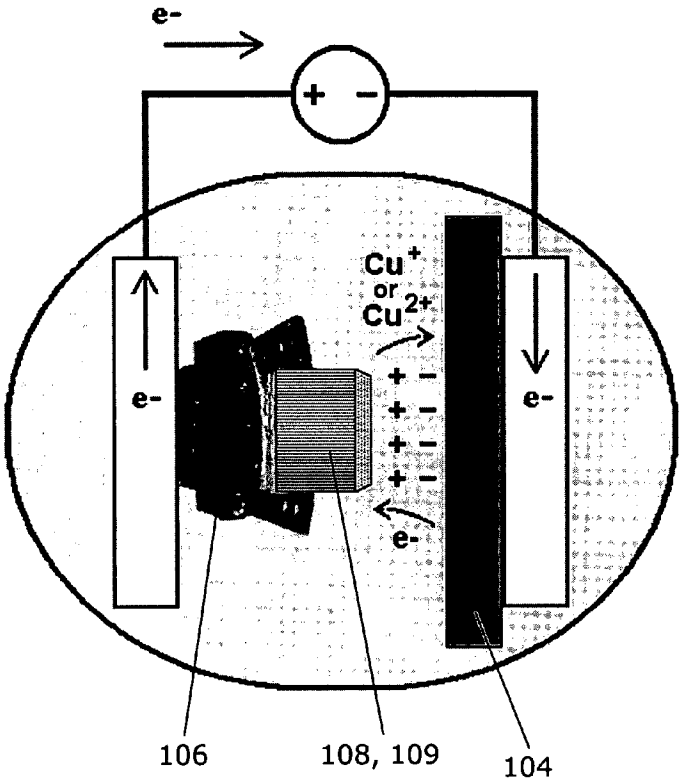
FIG. 6 is a diagram of a hypothetical electrochemical brush wear mechanism in the absence of the present invention's additive.

Reference is now made to FIG. 6, which illustrates a hypothetical electrochemical wear mechanism in non-inventive practice. Under normal conditions, electrons are conducted through a small gap (greatly exaggerated in the illustration) consisting of a few molecular layers of water. Copper metal in the brush fiber can act as an electron donor, thereby becoming a copper ion Cu+ or Cu2+ and dissolving into solution. The copper ion can then act as an electron acceptor, thereby becoming metallic copper and plating on the rotor. This situation would cause increased fiber wear and could also increase rotor surface roughness if the plating process is not uniform.

Figure 7:
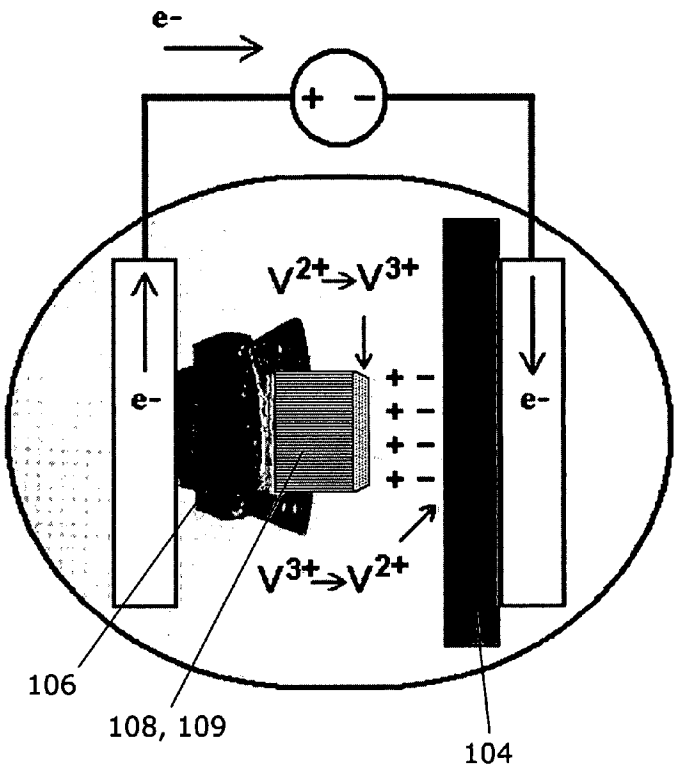
FIG. 7 is a diagram, similar to the diagram shown in FIG. 6, of a hypothetical electron shuttling mechanism in accordance with the present invention. The present invention's electron shuttling mechanism is a brush wear-preventive mechanism that occurs in the presence of an inventive additive such as the Vanadium-based additive shown in FIG. 7, which is an aqueous electrolyte solution that includes dual valence cations consisting of electron acceptors and electron donors.

With reference to FIG. 7, in accordance with the present invention, an ionic current shunt mechanism is provided by using an additive based on a dual-valance vanadium solution. Since the vanadium half-cell is less electro-positive than copper, V2+ preferentially acts as an electron donor rather than copper. This current shuttle mechanism can both prevent the ion current induced wear mechanism, and increase the electrical conductivity of the interface.

Among the various electrolytic solutions that are suitable for use in accordance with the present invention are certain electrolytic solutions that are known to be useful to store energy using redox-type reactions in flow batteries. Two known types of flow batteries are the Vanadium V(II,III)/V(IV,V) based battery system and the Sodium Bromide/Sodium Polysulfide based Innogy Regenesys battery system. These types of batteries store energy in two solutions respectively contained inside anolyte and catholyte tanks. Each of these solutions contains both electron acceptors and electron donors. As distinguished from flow battery applications, the present invention utilizes a single electrolytic solution rather than a plurality of electrolytic solutions. Not only compounds utilized in batteries, but other compounds, may be suitable for use in current collector applications in accordance with the present invention. Furthermore, the present invention utilizes the single electrolytic solution for ionic conduction purposes rather than for energy storage purposes.

FIG. 8 indicates the half-cell potentials and pH values expected for various ion-conducting solutions. For the anolyte, the Vanadium redox battery system uses a V(II) and V(III) electrolytic solution, which has a very low half-cell potential and should therefore be compatible with copper brushes, but it could therefore possibly evolve hydrogen gas. For the catholyte, the Vanadium redox battery system uses V(IV) and V(V) electrolytic solution, which has a high half cell potential and would require gold brushes in inventive practice. A V(III) and V(IV) electrolytic solution is also suitable for some inventive embodiments, albeit it is not used in the Vanadium redox battery because it would result in a low cell voltage. A V(III) and V(IV) solution is suitable for inventive use with silver brushes. Vanadium-based electrolytic solutions are made by dissolving vanadium oxide in sulfuric acid. The vanadium compounds are toxic.

The Regenesys system uses a catholyte containing NaBr and $NaBr_3$ solution, which has a very high half-cell potential and would require gold brushes in inventive practice. This solution also can liberate highly toxic bromine fumes. A solution containing KI and $KI_3$ should have similar characteristics; however, it would be less toxic and would have a lower half-cell potential. compatible with silver or palladium brushes. Iodine solution can be used as a precious metal etchant because of the formation of complex ions, and therefore may cause excessive corrosion in inventive practice; however, suitable mixtures of iodine electrolytic solution may be possible combined with metals that do not form complex ions. The Regenesys anolyte uses polysulfides $Na_2S_4$ and $Na_2S_2$. In inventive practice, this alkali solution should be compatible with all brush types; however, the formation of low solubility sulfides may require maintenance in terms of cleaning and solution replenishment.

Iron and chromium solutions have also been tested in flow batteries. These are less toxic than those used in the Vanadium and Regenesys systems. Cr(II) and Cr(III) or titanium salts could be used in the anolyte solution; however; the solution's low half cell potential indicates a possibility of hydrogen gas evolution and poor stability of the Cr(II) ions. Fe(II) and Fe(III) could be used in the catholyte solution. The solution would include ferric chloride etching solution containing $FeCl_3$ and HCl, with ferrous chloride $FeCl_2$ added. $Fe_2(SO_4)_3$, $H_2SO_4$ and $FeSO_4$ could also be used. The iron solutions should be compatible with gold brushes, and the iron sulfate solutions should also be compatible with gold and possibly palladium brushes.

FIG. 9 is a table of the conductivity of selected substances. According to typical inventive practice, the brush additives are strong electrolytes. FIG. 9 indicates that the conductivity of strong electrolytes is intermediate between that of weak electrolytes and that of metals including liquid types. The present invention's additive is orders of magnitude more conductive than that of the CO2 solution often used with brushes, serves to enhance the conductivity of the interface, and may be applicable with a significantly thicker film layer. An inventive additive provides a lower conduction power loss and/or a lower frictional power loss by allowing the brush to operate at lighter load pressure. Further, an inventive additive facilitates lower wear rates, by minimizing electrochemical, mechanical and thermal wear mechanisms. Since the inventive additive is orders of magnitude less conductive than metals, it should not contribute significantly to electrical shorts or leakage currents, provided that the slip ring assemblies include suitable separation and creepage paths between adjacent turns.

FIG. 10 is a water solubility table that can be used by an inventive practitioner for selecting materials in inventive practice. The materials shown include possible brush metals, additive ions and spectator ions. Metals used in fiber brushes are soluble when combined with most anions, especially halides; therefore, electrochemical dissolving of metals can occur if they are present in an aqueous solution within the brush interface and less electropositive electron donors are not present in the solution.

FIG. 11 is a table of some possible combinations of materials that can be used by an inventive practitioner such as in a slip ring assembly, wherein an inventive additive electrolyte contains electron donor and electron acceptor ions. Other materials may be considered, and not all permutations of the materials are compatible. A variety of alloys may be considered in addition to the pure materials, and their characteristics such as hardness, corrosion resistance, electrical conductivity, and cost may be optimized for various parts of the machine. The characteristics of alloys are generally not the same as the average of the characteristics of the component materials, and hence some alloys may offer significant advantages.

FIG. 12 is a result of a preliminary compatibility test. Small samples of the metals were placed in small vials of 1 molar solution, and any changes were observed. Since no electrical current is transferred, this test result does not guarantee a practical combination; however, it is an indicator of likely material compatibilities and generally correlates with expected results.

FIG. 13 is a table of characteristics of Iron-based additive solutions, and includes experimental results. The pH, half-cell voltage E, and conductivity values C were measured using commercially available laboratory instruments. The electrode drop was measured using a simplified model of the inventive device. This included a pair of electrodes with one square centimeter area each separated by 2 centimeters, which were immersed in the test electrolyte solution. A small current source supplied the 10 milliamp test current to the apparatus. In this proof of concept experiment, the separation is much larger, and the current is much smaller, than would be expected in a practical current collector device. This set of experiments validates the present invention's concept of the dual-valance additive, because the conductivity of the two-component solution (which is made by mixing 50% each of the constituent solutions) is significantly lower than that of either the electron donor solution or the electron acceptor solution alone.

Figure 14:
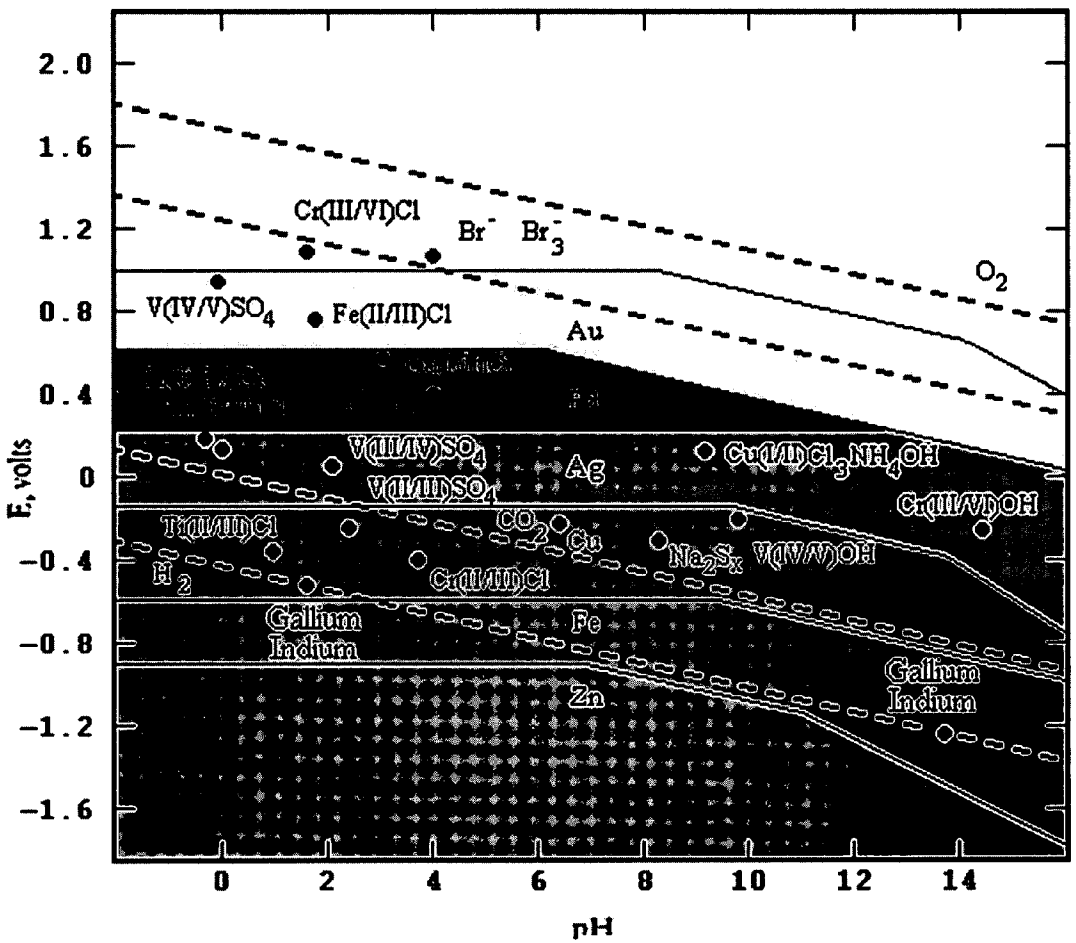
FIG. 14 is a graphical representation, known as a "Pourbaix Diagram," that indicates metal stability regions and conditions for selected additive solutions in accordance with the present invention.

FIG. 14 is a compilation of data related to Pourbaix diagrams that are shown in greater detail in Marcel Pourbaix, *Atlas of Electrochemical Equilibria in Aqueous Solutions*, $2^{nd}$ Edition, QD553.P6613, 1974. Relative stabilities of metals in aqueous solution can be indicated in Pourbaix diagrams such as illustrated in FIG. 14. Comparative inspection of the Pourbaix diagram reveals relative stability of metals (indicated by contrasting shaded areas in the Pourbaix diagram) and possible characteristics of additive solutions (indicated by points in the Pourbaix diagram). Each metal is stable in the shaded area indicated as well as lower areas. The metal would be likely to dissolve forming metal cations in a solution with characteristics above its stability region. The Porbaix diagram is based on the stability of metals in chloride solutions. In inventive practice, the stability of brush fiber metals will be higher for acids with other anions such as SO4, which do not form complex ions with the metals.

Figure 15:
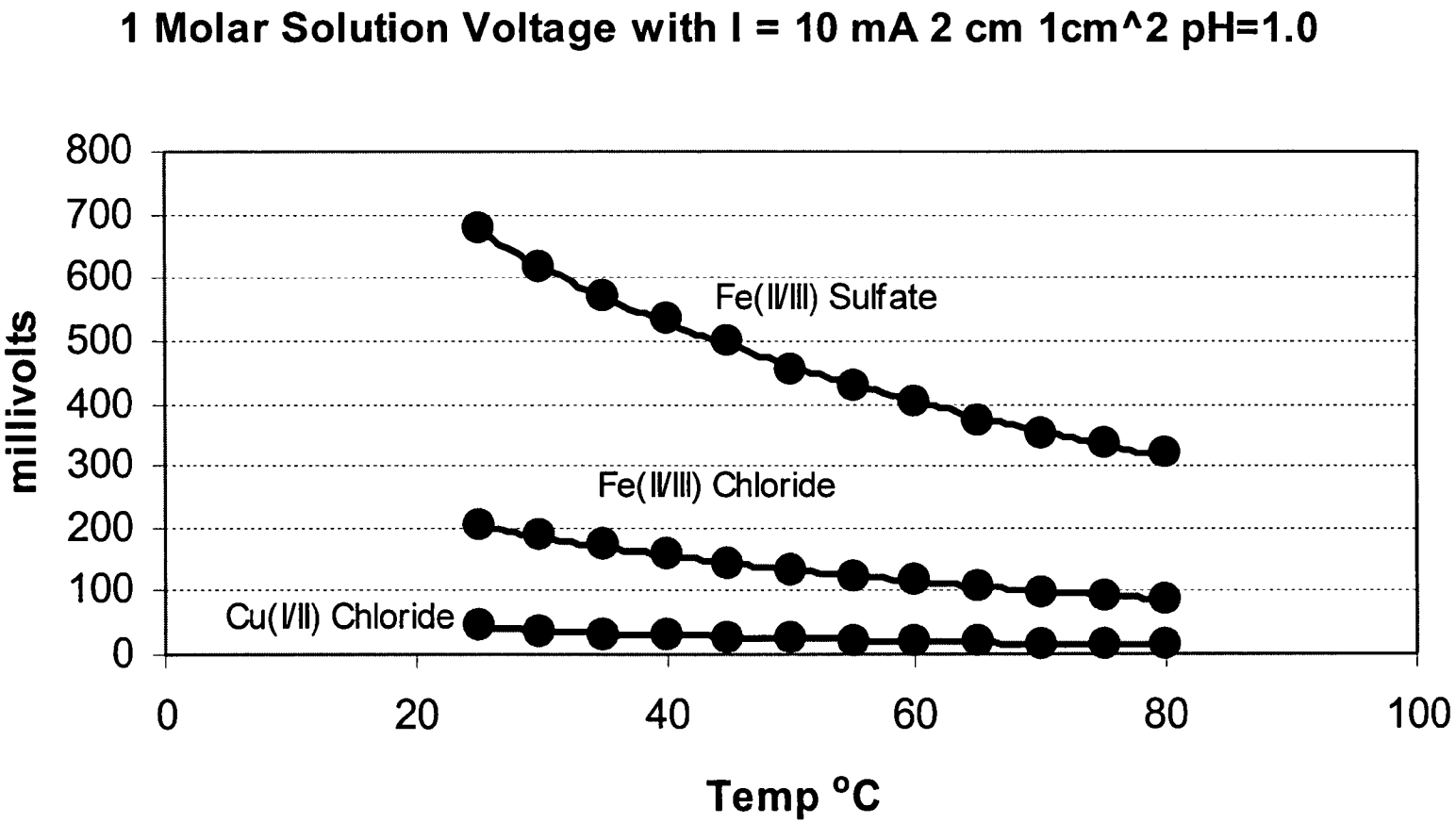
FIG. 15 is a graph indicating conductivity (high conductivity proportional to low millivolts) as a function of temperature (degrees Celsius) for three different additive solutions in accordance with the present invention.

FIG. 15 is a plot of the voltage drop across the electrodes as a function of temperature, which is inversely proportional to conductivity. This includes data on the original two iron-based additives as well as a copper-based additive. The copper-based additive provides a significantly lower voltage drop.

FIG. 16 is the tabular data presented in FIG. 15. The experiments were performed using 1 molar solutions with a pH of 1.00. In some cases, dilute acid and salt solutions were used to set the pH and to facilitate additive compound dissolving into solution.

FIG. 17 is similar to FIG. 13; however, FIG. 17 includes data on copper-based additives as well as variation in solution concentration. The copper-based additives provided significantly higher conductivity. Chloride anions provided higher conductivity than sulfate ions, and solutions with higher concentration provided higher conductivity. The iron-based additives are relatively simple to prepare by dissolving compounds in water and mixing 50% of each component solution, thereby making the present invention's dual-valance additive solution. Small amounts of dilute acid may be added to reduce the pH and to ensure no precipitate formation.

The copper-based additives are somewhat more difficult to prepare because of the low aqueous solubility of the Cu(I) (cuprous) ion. It complexes with chloride ions; therefore, addition of HCl (hydrochloric acid) is a possible technique for dissolving the Cu(I) chloride. Very concentrated acid was required to dissolve a 1 molar solution. This solution provided very high conductivity, but this highly acidic solution had a negative pH. Salt solution made with saturated NaCl was also used to produce a copper-based additive solution that was much less acidic and provided reasonably high conductivity. Further study of the copper-based additives as a function of salt concentration and pH could lead to further optimization of characteristics of the copper-based additive. A mildly alkali form of the copper-based additive can be made using a mixture of ammonium chloride and ammonium hydroxide in the solution. Other procedures would be required for other types of additives included in FIG. 8 and FIG. 14.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications and changes to the principles disclosed herein may be made by one skilled in the art without departing from the true scope and spirit of the present invention, which is indicated by the following claims.

What is claimed is:

1. Apparatus for conducting electricity between two objects that are moving relative to each other, said apparatus comprising a brush and an electrolytic solution, said brush being capable of electronic conduction of electricity between two objects while said brush is fixed with respect to the first said object and is in sliding contact at an interface of said brush with respect to the second said object, said electrolytic solution being capable of ionic conduction of electricity between said brush and the second said object while said electrolytic solution is situated at said interface, said apparatus thereby effecting an overall conduction of electricity between said objects that represents the sum of said electronic conduction and said ionic conduction.

2. The apparatus of claim 1 wherein said electrolytic solution is a strong electrolytic solution.

3. The apparatus of claim 2 wherein said electrolytic solution includes electron donor ions and electron acceptor ions, said electron donor ions being characterized by a first valence state, said electron acceptor ions being characterized by a second valence state.

4. The apparatus of claim 1 wherein said electrolytic solution includes two dissolved species of the same chemical substance, the first said species consisting of electron donor ions, the second said species consisting of electron acceptor ions, the first said species being characterized by a first valence state, the second said species being characterized by a second valence state.

5. The apparatus of claim 4 wherein said two dissolved species are elemental metal cations representing a redox couple selected from the group of redox couples consisting of Vanadium (II) and Vanadium (III), Vanadium (IV) and Vanadium (V), Chromium (II) and Chromium (III), Copper (I) and Copper (II), Titanium (II) and Titanium (III), and Iron (II) and Iron (III).

6. The apparatus of claim 4 wherein, during said electronic conduction and said ionic conduction:

said brush constitutes a first electrode;

the second said object constitutes a second electrode;

a first electrochemical reaction occurs at said first electrode;

a second electrochemical reaction occurs at said second electrode;

said first electrochemical reaction is one of oxidation and reduction;

said second electrochemical reaction is the other of oxidation and reduction;

an overall electrochemical reaction occurs in said apparatus;

said overall electrochemical reaction represents the sum of said first chemical reaction and said second chemical reaction;

said overall electrochemical reaction is at least approximately a zero net reaction).

7. The apparatus of claim 6 wherein, during said overall chemical reaction, said first electrode and said second electrode are each rendered at least substantially inert.

8. The apparatus of claim 6 wherein said brush is a fiber brush including a plurality of fibers, and wherein, at any moment during said electronic conduction and said ionic conduction:

more than half of said fibers are not in said sliding contact at said interface;

said electrolytic solution serves as an electrically conductive bridge between the second said object and said fibers that are not in said contact, said electrolytic solution thereby promoting constancy of said overall conduction of electricity.

9. The apparatus of claim 6 wherein said brush is a fiber brush including a plurality of fibers, and wherein, at any moment during said electronic conduction and said ionic conduction:

less than half of said fibers are in said sliding contact at said interface;

said electrolytic solution serves to increase the area of said electronic conduction in each said fiber.

10. The apparatus of claim 6 wherein said electrolytic solution is a strong electrolytic solution.

11. The apparatus of claim 1, said object further comprising a holder for affixing said brush with respect to the first said object.

12. The combination comprising electronic conduction means and ionic conduction means, said electronic conduction means including plural fibers for effecting electronic conduction during relatively moving contact of said fibers with a structure, said contact of at least some said fibers being characterized by intermittency associated with the relatively moving nature of said contact along with surface roughness characterizing said structure, said electronic conduction being characterized by discontinuity associated with said intermittency, said ionic conduction means including a strong electrolytic solution for effecting ionic conduction when placed in the vicinity of said contact, said ionic conduction supplementing said electronic conduction so as to promote the constancy of the overall conduction of electricity, said overall conduction representing the sum of said ionic conduction and said electronic conduction.

13. The combination of claim 12 wherein said electrolytic solution is an aqueous solution including an oxidizing agent and a reducing agent, and wherein an at least substantially neutral electrochemical cell reaction occurs in which said fibers constitute a first electrode and said structure constitutes a second electrode.

14. A method for conducting electricity between two objects that are moving relative to each other, said method comprising:

affixing a brush to a first object so that, during relative movement of the first said object and a second object, said brush is in sliding contact at an interface of said brush with respect to the second said object, and so that, during electrification of either the first said object or the second said object, said brush electronically conducts electricity from the electrified said object to the non-electrified said object; and situating a strong electrolytic solution at said interface so that, when said brush electronically conducts electricity, said electrolytic solution ionically conducts electricity either from said brush to the second said object or from said second said object to said brush, said electrolytic solution ionically conducting electricity from said brush to the second said object if the first said object is the electrified said object, said electrolytic solution ionically conducting electricity from the second said object to said brush if the second said object is the electrified said object.

15. The method of claim 14 wherein occurs an overall conduction of electricity between said objects that represents the sum of said electronic conduction and said ionic conduction.

16. The method of claim 14 wherein said electrolytic solution includes two dissolved species of the same chemical substance, the first said species being an oxidant, the second said species being a reductant, the first said species being characterized by a first oxidation number, the second said species being characterized by a second oxidation number, wherein said steps of affixing said brush and situating said electrolytic fluid are performed so that:

said brush constitutes a first electrode;

the second said object constitutes a second electrode;

a first electrochemical reaction occurs at said first electrode;

a second electrochemical reaction occurs at said second electrode;

said first electrochemical reaction is either oxidation or reduction;

said second electrochemical reaction is either oxidation or reduction, said second electrochemical reaction being oxidation if said first electrochemical reaction is reduction, said second electrochemical reaction being reduction if said first electrochemical reaction is oxidation;

an overall electrochemical reaction occurs representing the sum of said first chemical reaction and said second chemical reaction;

said overall electrochemical reaction is at least approximately a zero net reaction).

17. The method of claim 16 wherein, during said overall chemical reaction, said first electrode and said second electrode are each rendered at least substantially inert.

18. The method of claim 14 wherein:

said brush is a fiber brush including a plurality of fibers;

some said fibers are not in said sliding contact at said interface;

said electrolytic solution serves as an electrically conductive bridge between the second said object and said fibers that are not in said contact, said electrolytic solution thereby promoting constancy of the overall conduction of electricity between said objects, said overall conduction representing the sum of said electronic conduction and said ionic conduction.

19. The method of claim 14 wherein said two dissolved species are elemental metal cations representing a redox couple selected from the group of redox couples consisting of Vanadium (II) and Vanadium (III), Vanadium (IV) and Vanadium (V), Chromium (II) and Chromium (III), Copper (I) and Copper (II), Titanium (II) and Titanium (III), and Iron (II) and Iron (III).

20. The method of claim 14 wherein said affixing of said brush to the first said object includes using a holder for said brush.

* * * * *